US007667676B2

(12) United States Patent
Aoki

(10) Patent No.: US 7,667,676 B2
(45) Date of Patent: Feb. 23, 2010

(54) IMAGE SIGNAL PROCESSING DEVICE, IMAGE SIGNAL PROCESSING METHOD, ELECTRO-OPTICAL DEVICE, AND ELECTRONIC APPARATUS

(75) Inventor: Toru Aoki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 1332 days.

(21) Appl. No.: 10/969,003

(22) Filed: Oct. 21, 2004

(65) Prior Publication Data

US 2005/0134538 A1 Jun. 23, 2005

(30) Foreign Application Priority Data

Oct. 31, 2003 (JP) ..... 2003-372588
Sep. 17, 2004 (JP) ..... 2004-270892

(51) Int. Cl.
*G09G 3/36* (2006.01)

(52) U.S. Cl. ..... 345/87; 345/98

(58) Field of Classification Search ..... 345/76–77, 345/87–100, 204–214
See application file for complete search history.

(56) References Cited

U.S. PATENT DOCUMENTS

| | | | | |
|---|---|---|---|---|
| 6,259,425 | B1 | 7/2001 | Shimizu | |
| 6,329,980 | B1 | 12/2001 | Uehara et al. | |
| 6,603,452 | B1 * | 8/2003 | Serita | 345/88 |
| 6,943,765 | B2 | 9/2005 | Aoki | |
| 6,952,287 | B2 | 10/2005 | Aoki | |
| 7,148,871 | B2 * | 12/2006 | Sekine | 345/98 |
| 2005/0206601 | A1 | 9/2005 | Aoki | |

FOREIGN PATENT DOCUMENTS

| | | |
|---|---|---|
| CN | 1402210 A | 3/2003 |
| JP | A 06-160799 | 6/1994 |
| JP | A 10-293564 | 11/1998 |
| JP | A 11-065536 | 3/1999 |
| JP | A-11-113019 | 4/1999 |
| JP | A 11-282426 | 10/1999 |
| JP | A 2001-343954 | 12/2001 |
| JP | A-2002-149136 | 5/2002 |
| JP | A 2002-297111 | 10/2002 |
| JP | A 2003-099016 | 4/2003 |
| JP | A-2003-157064 | 5/2003 |
| KR | A 1998-080944 | 11/1998 |

* cited by examiner

*Primary Examiner*—Richard Hjerpe
*Assistant Examiner*—Mansour M Said
(74) *Attorney, Agent, or Firm*—Oliff & Berridge, PLC

(57) ABSTRACT

Exemplary embodiments of the present invention reduce display irregularity in order to enhance display quality. A liquid crystal panel includes a plurality of pixel electrodes provided at intersections of a plurality of scanning lines and a plurality of data lines, a scanning line driving circuit to sequentially select the plurality of scanning lines, and a data line driving circuit to sample an image signal VID supplied to an image signal line that is provided in common to the plurality of data lines and to supply the sampled signal to each data line. A signal correcting circuit has a correction amount specifying circuit to specify a correction amount α of the image signal VID to be supplied to each data line based on the position of the data line with respect to the extending direction of the image signal line; and a correcting circuit to correct the image signal VID based on the correction amount α specified by the correction amount specifying circuit and to supply the corrected image signal VID to the image signal line.

13 Claims, 9 Drawing Sheets

IMAGE SIGNAL PROCESSING DEVICE, IMAGE SIGNAL PROCESSING METHOD, ELECTRO-OPTICAL DEVICE, AND ELECTRONIC APPARATUS

BACKGROUND OF THE INVENTION

1. Field of Invention

Exemplary embodiments of the present invention relate to a technique of correcting image signals in an electronic apparatus that displays an image using an electro-optical material, such as liquid crystal.

2. Description of Related Art

The related art discloses various electro-optical devices that display images using an electro-optical material whose optical characteristics vary according to an electrical action. For example, related art document Japanese Unexamined Patent Application Publication No. 2002-149136 (see paragraphs 0005 to 0014 and FIG. 12) discloses an electro-optical device including pixel electrodes connected to scanning lines and data lines through switching elements, a scanning line driving circuit to sequentially select the scanning lines, an image signal line provided in common to the plurality of data lines, and a data line driving circuit to sample an image signal supplied to the image signal line to supply the sampled signal to each data line.

SUMMARY OF THE INVENTION

However, according to the above-mentioned structure, there is a problem in that the difference between a predetermined grayscale level and a grayscale level that is actually displayed, is changed along the extending direction of the image signal line. For example, even when the image signal is selected such that all pixels are displayed at the same grayscale level, a voltage applied to the pixel electrode located at the downstream side of the image signal line in the transmission direction of the image signal, is smaller than a voltage applied to the pixel electrode located at the upstream side thereof. In this case, in a liquid crystal device of a normally white mode, the grayscale of the pixel becomes brighter as the pixel is located nearer to the downstream side in the transmission direction of the image signal. Such a difference in grayscale is perceived as display irregularity (shades of a display color) by an observer, which causes the deterioration of display quality. Exemplary embodiments of the present invention are designed to address and/or solve the above-mentioned and/or other problems, and it is an object of exemplary embodiments of the present invention to remove display irregularity, thereby enhancing display quality.

Exemplary embodiments of the present invention are particularly suitable to correct an image signal in an electro-optical device including a plurality of pixel electrodes electrically connected to a plurality of scanning lines and a plurality of data lines through switching elements provided at intersections of the plurality of scanning lines and the plurality of data lines; a counter electrode opposite to the plurality of pixel electrodes, with an electro-optical material interposed therebetween; a scanning line driving circuit to sequentially select the plurality of scanning lines; and a data line driving circuit to sample an image signal to supply the sampled signal to each data line. The electro-optical material is a material whose optical characteristics, such as transmittance and brightness, are changed according to an electrical action, such as the supply or application of a voltage. Examples of the electro-optical material include liquid crystal whose arrangement direction (transmittance) varies according to the applied voltage, an electroluminescent (EL) material whose brightness varies according to a current, and an organic light-emitting diode (OLED) element, such as a light-emitting polymer.

In the electro-optical device having the above-mentioned structure, the image signal is supplied through the image signal line common to the plurality of data lines, and the data line driving circuit samples the image signal supplied through the image signal line in a period in which the scanning line is selected and outputs the sampled signal to each data line. In this structure, parasitic capacitance is generated between the image signal line and the counter electrode (or other conductors), and the image signal line has intrinsic resistance. The present inventors found out the fact that the parasitic capacitance and the resistance caused display irregularity. That is, the image signal transmitted through the image signal line may have waveform distortion or phase delay caused by the parasitic capacitance and resistance of the image signal line. The further the distance from a point (a terminal for supplying the image signal to the image signal line) where the image signal is input on the image signal line is separated from, the larger the parasitic capacitance or the resistance becomes. Therefore, the effects of the waveform distortion and the phase delay (hereinafter, these phenomena are generally referred to as 'signal distortion') caused by the parasitic capacitance or the resistance become larger nearer to the downstream side of the image signal line in the transmission direction of the image signal. The level of the image signal supplied to the respective pixel electrodes varies due to a difference in the degree of signal distortion, which results in display irregularity. Exemplary embodiments of the present invention are designed to solve this and/or other problems. According to the first feature of exemplary embodiments of the present invention, the correction amount of the image signal to be supplied to each data line is specified based on the position of the data line with respect to the extending direction of the image signal line (for example, according to the right or left side of a display region in which pixels are arranged in a plane), and the image signal is corrected based on the correction amount to be supplied to the image signal line. According to this structure, since the correction amount of the image signal is specified according to the position of the data line with respect to the extending direction of the image signal line, a difference in the signal distortion of the image signal according to the position of the data line (more specifically, a point where the image signal is sampled on the image signal line) is compensated, thereby reducing or preventing display irregularity.

In a concrete exemplary aspect of the present invention, a correcting device increases the signal level of the image signal with respect to a voltage applied to the counter electrode by the correction amount. As described above, the degree of signal distortion becomes larger nearer to the downstream side of the image signal line in the transmission direction of the image signal. Therefore, a specifying device according to this exemplary aspect preferably specifies the correction amount of each image signal such that the correction amount of the image signal supplied to the data line located at the downstream side of the image signal line in the transmission direction of the image signal is larger than the correction amount of the image signal supplied to the data line located at the upstream side of the image signal line in the transmission direction of the image signal.

Further, exemplary embodiments of the present invention address the signal distortion of the image signal, but signal distortion generated in other signals may cause the display irregularity. For example, in the electro-optical device, the data line driving circuit may sample the image signal of the image signal line based on a sampling signal corresponding to the logical product of a pulse signal sequentially generated within a period in which the scanning line is selected and an enable signal supplied to an enable signal line common to the plurality of data lines and then supply the sampled signal to each data line. In this structure, similar to the description about the image signal line, signal distortion (particularly, phase delay) is generated in the enable signal due to the intrinsic resistance of the enable signal line and the parasitic capacitance generated between the enable signal line and the counter electrode (or other conductors), and the degree of signal distortion depends on the position of the data line with respect to the transmission direction of the enable signal. Further, since a period in which the image signal is sampled to the data line is determined by the enable signal, a difference in the signal distortion of the enable signal may cause display irregularity, similar to the signal distortion of the image signal. In order to address and/or solve this problem, according to the second feature of the present invention, the correction amount of the image signal to be supplied to each data line is specified based on the position of the data line with respect to the extending direction of the enable signal line, and the image signal is corrected based on the correction amount to be supplied to the image signal line. According to this structure, since the correction amount of the image signal is specified based on the position of the data line with respect to the enable signal line, a difference in the signal distortion of the enable signal according to the position of the data line (more specifically, a point on the enable signal line where the enable signal is extracted to calculate the logical product with the pulse signal) is compensated, thereby reducing or preventing display irregularity.

In another exemplary aspect of the present invention according to the first and second features, the specifying device reads out the correction amount corresponding to the data line to be supplied with the image signal from a storage unit in which the correction amounts respectively corresponding to two or more data lines are stored, and uses the read correction amount as the correction amount of the corresponding image signal. According to this exemplary aspect, since the correction amount is specified based on the contents stored in the storage unit, it is possible to reduce the number of calculating processes, compared to a structure in which the correction amount is calculated by various calculating processes, thereby rapidly specifying the correction amount. Alternatively, a structure in which the correction amount is calculated by a predetermined calculating process may be used. For example, the correction amount may be calculated by a predetermined calculating process in which the position of the data line is used as a variable. In addition, only the correction amounts corresponding to some of the plurality of data lines may be stored in the storage unit, and the correction amounts corresponding to the other data lines of the plurality of data lines may be specified by interpolating the correction amounts corresponding to some of the plurality of data lines. In this exemplary aspect, a typical example of the interpolating process is a linear interpolating process, but other interpolating processes can be used.

Further, it is necessary for an electro-optical device to have a display operation for inverting the upper and lower sides of an image. For example, if necessary, a projector using the electro-optical device as a light valve (a member for modulating the intensity of light of each pixel to be projected on a screen) needs to have a usage mode in which a main body thereof is provided on a floor to display an image or another usage mode in which the main body is provided on the ceiling to display an image, which is an inverted position of the main body with respect to the former. A data line driving circuit of such an electro-optical device is operated according to a first operating mode in which the sampling of the image signal is sequentially performed from the data line located at one side of the arrangement direction of the plurality of data lines toward the data line located at the other side thereof or a second operating mode in which the sampling of the image signal is sequentially performed from the data line located at the other side of the arrangement direction of the plurality of data line towards the data line located at the one side thereof. According to this structure, when the transmission direction of the image signal on the image signal line and the transmission direction of the enable signal on the enable signal line are fixed regardless of the operating mode, the transmission direction of each signal is reverse to the sampling direction thereof according to the operating mode. Therefore, the optimum correction amount specified in accordance with the position of the data line may be different in the respective operating modes. Thus, when exemplary embodiments of the present invention are applied to this type of electro-optical device, it is preferable that the specifying device specify the correction amount of the image signal based on the operating mode of the data line driving circuit as well as the position of the data line.

Furthermore, in still another exemplary aspect of the present invention, a phase developing device to phase-develop the image signal to a plurality of image signals to output the phase-developed image signal, is provided at the front stage of the image signal line, and the data line driving circuit simultaneously supplies the respective image signals phase-developed by the phase developing device to the respective data lines corresponding to the number of phases developed by the phase developing device. According to this exemplary aspect, an operating frequency required for the data line driving circuit is reduced, compared to a method in which the respective data lines are dot-sequentially driven. In addition, when a shift register is used as an output circuit to output a pulse signal, the number of stages of the shift register is reduced. Further, the positional relationship between the phase developing device and the correcting circuit does not matter. That is, the phase developing device may be provided at the front stage of the correction device such that the respective image signals phase-developed by the phase developing device are corrected by the correcting device, or the phase developing device may be provided at the rear stage of the correcting device such that the image signal corrected by the correcting device is phase-developed by the phase developing device.

Exemplary embodiments of the present invention can be realized by a method for processing the image signal by the procedure according to the first or second feature or by an electro-optical device equipped with the image signal processing device having the first or second feature, in addition to the image signal processing device. Further, an electronic apparatus equipped with the electro-optical device according to exemplary embodiments of the present invention makes it possible to suppress display irregularity and thus to display a high-quality image.

DETAILED DESCRIPTION OF PREFERRED EMBODIMENTS

Hereinafter, exemplary embodiments of the present invention will be described with reference to the accompanying drawings. In exemplary embodiments which will be described below, the present invention is applied to a liquid crystal device in which liquid crystal is used as an electro-optical material, but the exemplary embodiments of the present invention are not limited to this type of liquid crystal device. That is, various exemplary modifications and variations thereof can be made without departing from the scope of the present invention. In addition, in the figures, which will be referred to in the following description, each component has different dimension and reduced scale from its actual dimension and reduced scale so as to be easily viewed in the figures.

Liquid Crystal Device

Figure 1:
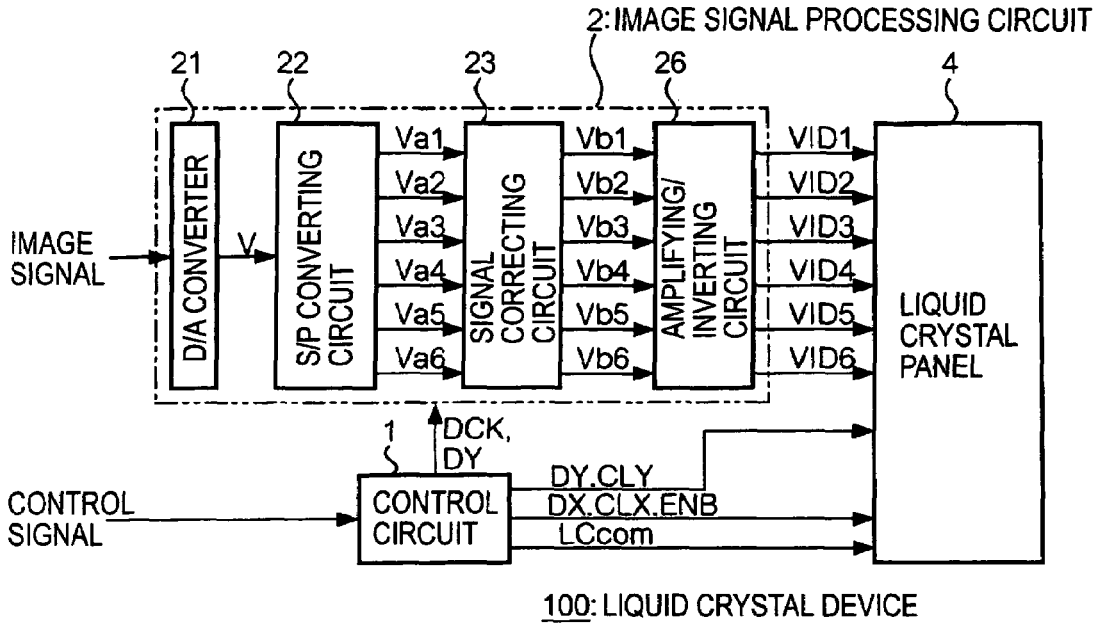
FIG. 1 is a schematic block diagram illustrating the entire structure of a liquid crystal device according to an exemplary embodiment of the present invention.

FIG. 1 is a schematic block diagram illustrating a functional structure of a liquid crystal device according to the present exemplary embodiment. As shown in FIG. 1, a liquid crystal device 100 has a control circuit 1, an image signal processing circuit 2, and a liquid crystal panel 4. The control circuit 1 is a circuit to control each unit of the liquid crystal device 100 based on control signals (for example, dot clock signals DCK) supplied from various host devices, such as a CPU (Central Processing Unit) of an electronic apparatus and the like.

The image signal processing circuit 2 is a circuit to convert a digital image signal supplied from a host device into a signal suitable for being supplied to the liquid crystal panel 4 and has a D/A (Digital to Analog) converter 21, a S/P (Serial to Parallel) converting circuit 22, a signal correcting circuit 23, and an amplifying/inverting circuit 26. The D/A converter 21 converts a digital image signal supplied from a host device into an analog image signal V and then outputs the analog signal. The S/P converting circuit 22 is a circuit to phase-develop the image signal V supplied from the D/A converter 21 into plurality types of image signals (six types of image signals in the present exemplary embodiment) and for extending (serial-to-parallel converting) the signals of the respective types by N times in the axial direction of time to output the extended signals as phase-developed image signals Va1, Va2, . . . , Va6 (see FIG. 5). Further, the signal correcting circuit 23 is a circuit to perform a correction process on the respective phase-developed image signals Va1, Va2, . . . , Va6 and to output the corrected signals as corrected image signals Vb1, Vb2, . . . , Vb6. In addition, the detailed structure and operation of the signal correcting circuit 23 will be described later.

The amplifying/inverting circuit 26 is a circuit to invert some of the corrected image signals Vb1, Vb2, . . . , Vb6 to be subjected to polarity inversion and to appropriately amplify the respective corrected image signals Vb1, Vb2, . . . , Vb6 to output the amplified signals to the liquid crystal panel 4 as image signals VID1, VID2, . . . , VID6. Here, the term 'polarity inversion' means that the voltage level of each of the corrected image signals Vb1, Vb2, . . . , Vb6 is alternately switched from either of a positive polarity and a negative polarity to the other on the basis of a voltage LCcom (or other constant voltages) to be applied to a counter electrode, which will be described later. The corrected image signals to be subjected to the polarity inversion are appropriately selected according to a manner of applying a voltage to each pixel, that is, according to any one of the following manners: (1) a manner in which the polarity inversion is performed for every scanning line (so-called row inversion), (2) a manner in which the polarity inversion is performed for every data line (so-called column inversion), and (3) a manner in which the polarity inversion is performed for every adjacent pixels (so-called pixel inversion). In addition, an inversion period thereof is set to one horizontal scanning period or a dot clock period. When it is not necessary to particularly distinguish the respective image signals VID1, VID2, . . . , VID6, the image signals are generally referred to as 'an image signal VID'. Further, in the present exemplary embodiment, the D/A converting process is performed prior to the S/P converting process, the correcting process, and the amplifying/inverting process, but exemplary embodiments of the present invention are not limited to this structure. In other words, the D/A converting process may be performed after the above-mentioned processes or between the processes.

Figure 2:
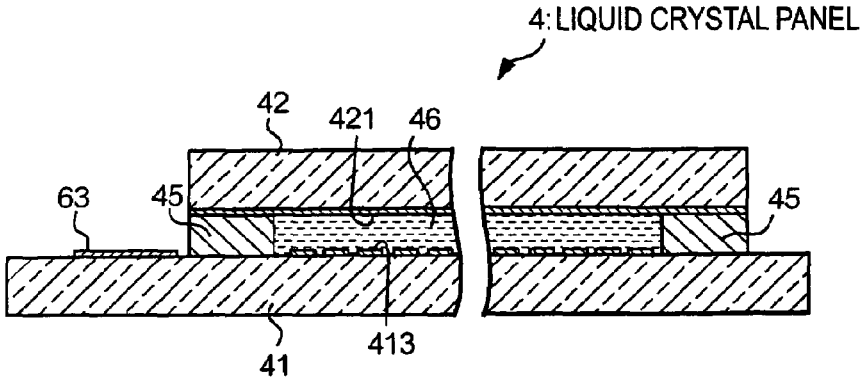
FIG. 2 is a schematic cross-sectional view illustrating the structure of a liquid crystal panel of the liquid crystal device.

Meanwhile, the liquid crystal panel 4 is a member to display an image using a plurality of pixels arranged in a matrix in the X direction (the row direction) and the Y direction (the column direction). As shown in FIG. 2, the liquid crystal panel 4 has an element substrate 41 and a counter substrate 42 that are bonded so as to be opposite to each other with a sealing material 45 having substantially a rectangular frame shape interposed therebetween. Each of the element substrate 41 and the counter substrate 42 is a plate-shaped or a film-shaped member made of glass or plastic. For example, twisted nematic (TN)-type liquid crystal 46, serving as an electro-optical material, is sealed inside a region surrounded by both the substrates and the sealing material 45. In addition, the liquid crystal panel 4 is electrically connected to a printed substrate through a flexible wiring substrate bonded to the element substrate 41 (this structure is not shown in FIG. 2). The control circuit 1 and the image signal processing circuit 2 are mounted on the printed substrate.

A counter electrode 421 is provided on a surface of the counter substrate 42 opposite to the element substrate 41. The counter electrode 421 is electrically connected to wiring lines (not shown) on the element substrate 41 through a conductive material provided at least one of four corners of the counter substrate 42, and the voltage LCcom is applied to the counter electrode 421 by the control circuit 1. In addition, a colored layer (color filters) (not shown) that is provided to correspond to each pixel and selectively transmits light having a predetermined wavelength and a shielding layer (not shown) that is provided to overlap regions other than the pixels and shields light are provided on the counter substrate 42. Further, the colored layer is not needed when light having a wavelength corresponding to a specific color is modulated as in a projector (see FIG. 13), which will be described later.

Figure 3:
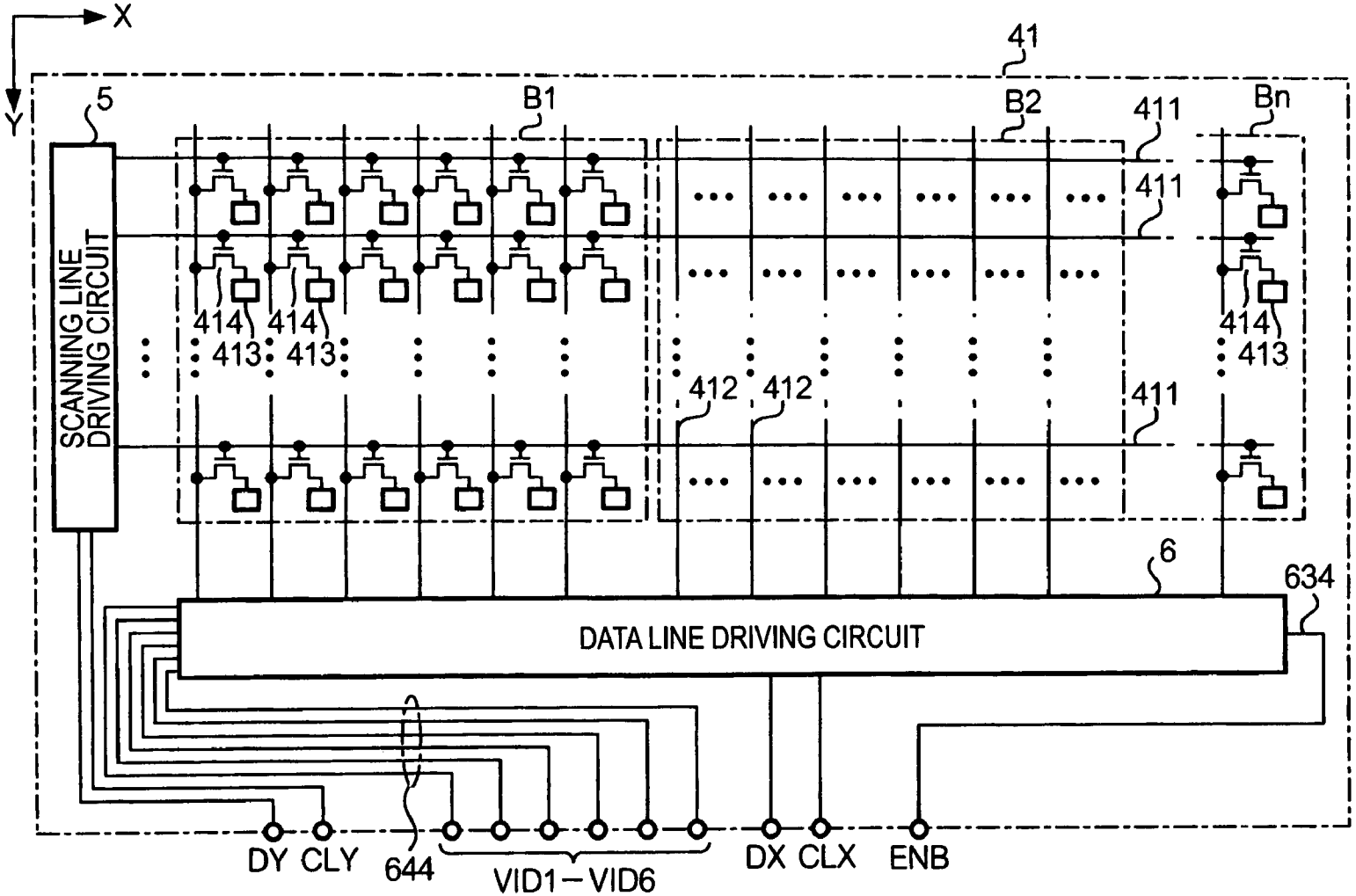
FIG. 3 is a schematic block diagram illustrating the structure of each element provided on an element substrate of the liquid crystal panel.

FIG. 3 is a schematic block diagram illustrating an electrical structure of each element provided on the element substrate 41. As shown in FIG. 3, a plurality of scanning lines 411 extending in the X direction to be connected to a scanning line driving circuit 5 and a plurality of data lines 412 extending in the Y direction to be connected to a data line driving circuit 6 are provided on a surface of the element substrate 41 opposite to the counter substrate 42. In addition, as shown in FIGS. 2 and 3, pixel electrodes 413 are provided at intersections of the plurality of scanning lines 411 and the plurality of data lines 412, respectively. Each of the pixel electrodes 413 is substantially a rectangular electrode opposite to the counter electrode 421 with the liquid crystal 46 interposed therebetween, and the respective pixel electrodes 413 are connected to the scanning lines 411 and the data lines 412 through thin film transistors (hereinafter, referred to as 'TFTs') 414. More specifically, a gate of the TFT 414 is connected to the scanning line 411, and a source thereof is connected to the data line 412. In addition, a drain thereof is connected to the pixel electrode 413. According to this structure, a pixel is composed of the pixel electrode 413, the counter electrode 421, and the liquid crystal 46 interposed therebetween. In the present exemplary embodiment, the number of scanning lines 411 is set to 'm' (where m is a natural number greater than or equal to 2), and the number of data lines 412 is set to '6n' (where n is a natural number greater than or equal to 1). Then, the plurality of pixel electrodes 413 is arranged in a matrix of m rows by 6n columns in the X direction and the Y direction. In addition, a total of 6n data lines 412 are divided into n blocks B (B1, B2, . . . , Bn) each consisting of six data lines corresponding to the number of developed phases of the pixel signal V. Therefore, the six image signals VID1, VID2, . . . , VID6 phase-developed by the S/P converting circuit 22 are respectively supplied to the six data lines 412 belonging to one block Bj (where j is a natural number from 1 to n) at a time.

Figure 5:
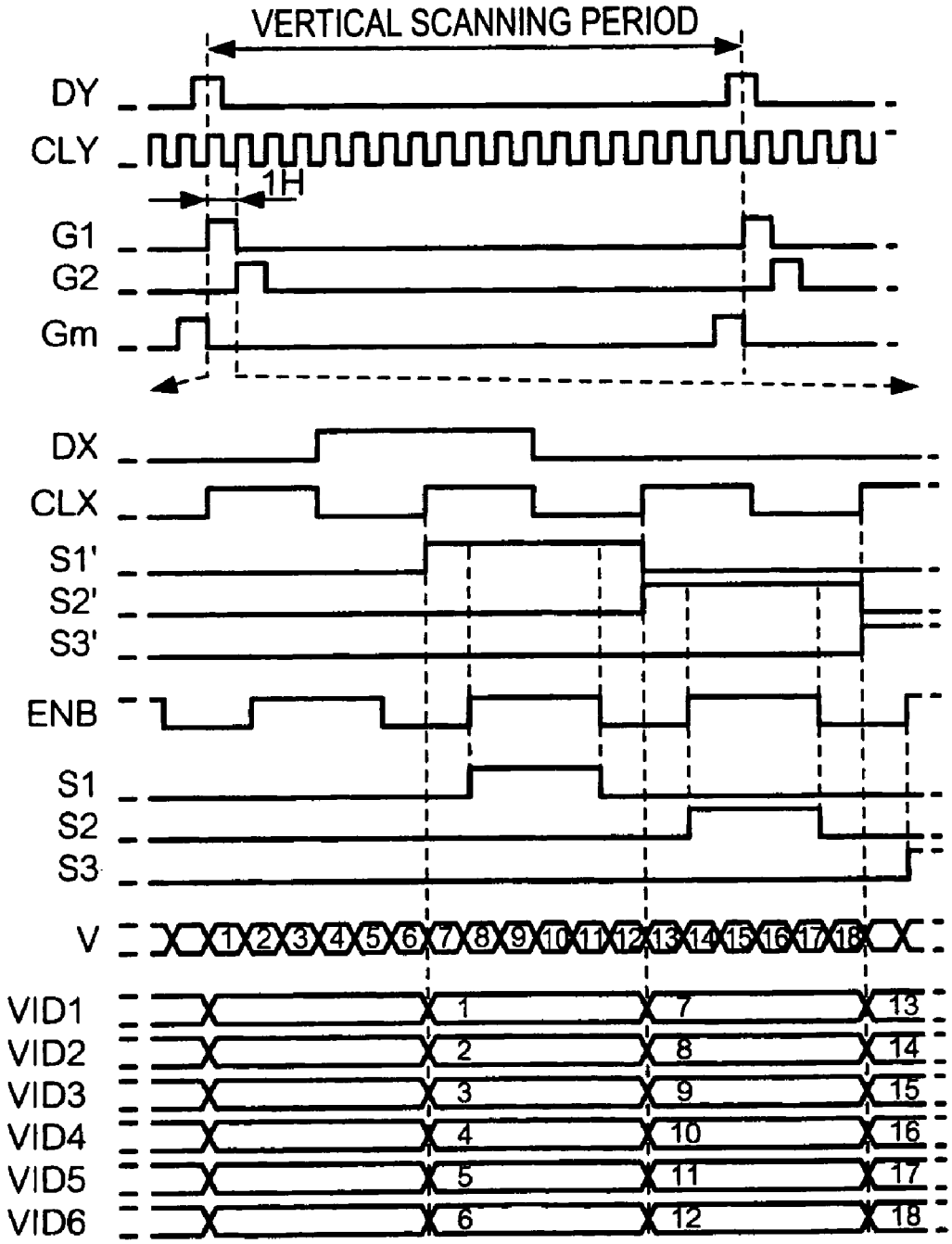
FIG. 5 is a timing chart for explaining the operation of the liquid crystal device.

The scanning line driving circuit 5 and the data line driving circuit 6 are circuits to drive the respective pixels. Elements (for example, switching elements) constituting these circuits are formed in the same manufacturing process as the process for forming the TFTs 414 provided in the respective pixels. The scanning line driving circuit 5 is a circuit to sequentially select the plurality of scanning lines 411. In the present embodiment, the scanning line driving circuit 5 has an m-bit shift register and outputs a scanning signal Gi (where i is a natural number in the range of 1 to m) that is sequentially turned to an active level every horizontal scanning period to each of the m scanning lines 411 every vertical scanning period. More specifically, as shown in FIG. 5, the scanning line driving circuit 5 sequentially shifts a transmission starting pulse DY supplied from the control circuit 1 at the beginning of the vertical scanning period, according to a clock signal CLY (a clock signal having a period of time corresponding to one horizontal scanning period) similarly supplied from the control circuit 1, and then outputs the shifted signals as scanning signals G1, G2, . . . , Gm. When the scanning signal Gi supplied to the respective scanning lines 411 becomes an active level, the TFTs 414 in one row that are connected to the scanning line 411 are simultaneously turned on.

Figure 4:
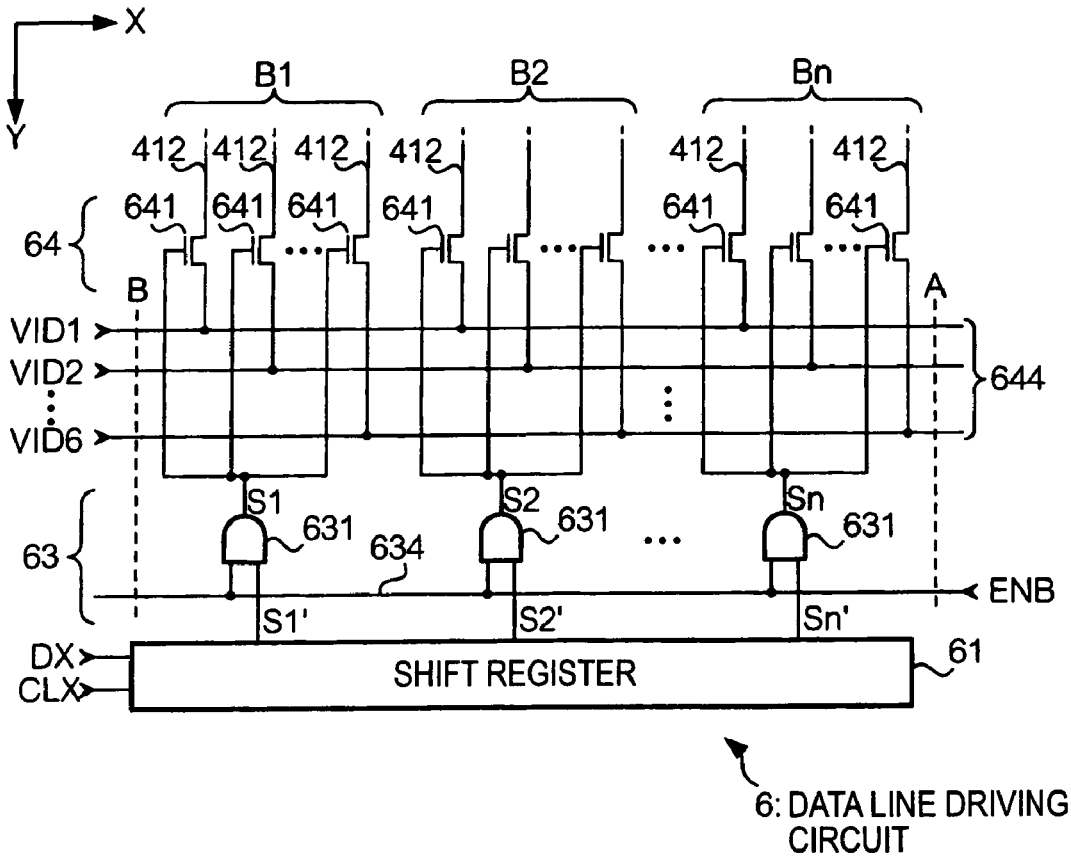
FIG. 4 is a schematic block diagram illustrating the structure of a data line driving circuit of the liquid crystal panel.

Meanwhile, the data line driving circuit 6 is a circuit to sample the image signals VID1 to VID6 supplied through image signal lines 644 and to output the sampled signals to the respective data lines 412. As shown in FIG. 4, the data line driving circuit 6 of the present exemplary embodiment has an n-bit shift register 61, an enable circuit 63, and a sampling circuit 64. Here, the number of bits of the shift register 61 corresponds to the number of blocks. As shown in FIG. 5, the shift register 61 sequentially shifts a transmission starting pulse DX supplied from the control circuit 1 at the beginning of the horizontal scanning period, according to a clock signal CLX (a clock signal having a period of time corresponding to six periods of the dot clock DCK) similarly supplied from the control circuit 1, and then outputs the shifted signals as pulse signals S1', S2', . . . , Sn'.

Figure 11A:
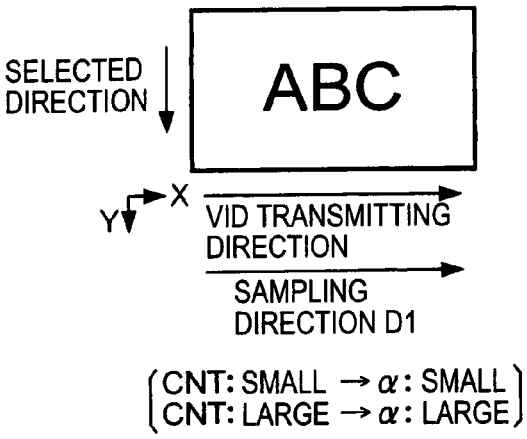
FIGS. 11A and 11B are schematic views explaining the sampling direction and the magnitude of the correction amount in each operating mode.
Figure 11B:
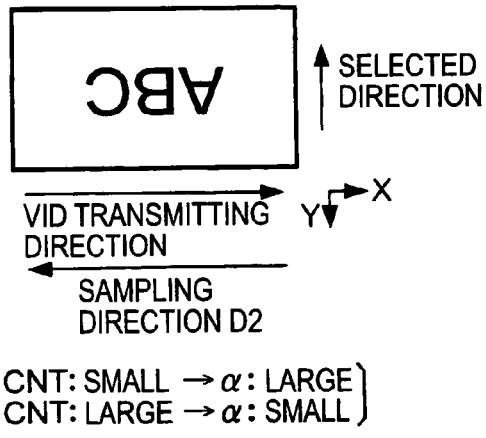

Therefore, in an electronic apparatus equipped with the liquid crystal device 100, if necessary, the upper and lower sides or the right and left sides of an image to be displayed may be inverted. For example, a projector in which the liquid crystal device 100 is used as a light valve may have a usage mode in which a main body thereof is provided on a floor so as to face the upper side of the vertical direction to display an image and another usage mode in which the main body is provided on the ceiling so as to face the lower side of the vertical direction to display an image, which is an inverted state of the main body contrary to the former. Therefore, it is necessary to invert the upper and lower sides or the right and left sides of an image according to the usage mode. In order to correspond to the switching of the usage mode, the liquid crystal device 100 of the present exemplary embodiment has two operating modes in which the sampling directions (the order of sampling) of the image signal VID with respect to the plurality of data lines 412 are different from each other. In a first operating mode of them, as shown in FIG. 11A, the scanning signal Gi is sequentially turned to the active level from the scanning line 411 located at the negative side of the Y direction on a display surface toward the scanning line 411 located at the positive side thereof, and the sampling of the image signal VID is sequentially performed in the order (that is, along the sampling direction D1 shown in FIG. 11A) from the data line 412 located at the negative side of the X direction toward the data line 412 located at the positive side thereof in each horizontal scanning period. Meanwhile, in a second operating mode, as shown in FIG. 11B, the sampling of the scanning signal Gi is sequentially performed from the scanning line 411 located at the positive side of the Y direction on the display surface toward the scanning line 411 located at the negative side thereof, and the sampling of the image signal VID is sequentially performed in the order (that is, along the sampling direction D2 shown in FIG. 11B) from the data line 412 located at the positive side of the X direction toward the data line 412 located at the negative side thereof in each horizontal scanning period. In order to realize the switching, the shift register of the scanning line driving circuit 5 and the shift register 61 of the data line driving circuit 6 according to the present exemplary embodiment switch the shift directions of the transmission starting pulses DY and DX according to the operating mode. More specifically, in the first operating mode, the scanning signals G1, G2, . . . , Gm are turned to the active level in this order, and the pulse signals S1', S2', . . . , Sn' are output in this order. On the other hand, in the second operating mode, the scanning signals Gm, . . . , G2, G1 are turned to the active level in this order, and the pulse signals Sn', . . . , S2', S1' are output in this order. In the meantime, since the contents (particularly, the order of the image signal V with respect to each pixel) of the image signal V is fixed regardless of the operating mode, the upper and lower sides or the right and left sides of an image (letters 'ABC' shown in FIG. 11) displayed by the liquid crystal device 100 are inverted in each operating mode. The selection of the operating mode to be particularly applied is performed by the operation of a user with respect to an operating tool (not shown).

The enable circuit 63 shown in FIG. 4 is a circuit for determining whether to permit the sampling of the image signal VID with respect to a pulse signal Sj', and has n AND gates 631 corresponding to the number of blocks (in other words, the number of stages of the shift register 61). In each AND gate 631, one input terminal is connected to an output terminal of the shift register 61. In addition, one of the pulse signals S1', S2', . . . , Sn' is supplied to one input terminal of each of the AND gates 631. The other input terminal of each of the AND gates 631 is connected to a common enable signal line 634. The enable signal line 634 is a wiring line to transmit an enable signal ENB output from the control circuit 1. More specifically, the enable signal line 634 extends to the element substrate 41 so as to reach the right end of the data line driving circuit 6 shown in FIG. 3 from the control circuit 1 and further extends at that point in the X direction, which is the direction in which the data lines 412 are arranged. Therefore, the enable signal ENB output from the control circuit 1 is transmitted from a point A located at the positive side of the enable signal line 634 in the X direction toward a point B located at the negative side thereof (that is, in the left direction in FIGS. 3 and 4). Further, as shown in FIG. 4, the input terminals of the respective AND gates 631 are connected to the enable signal line 634 at different points in the extending direction. According to this structure, the logical product of the enable signal ENB and the pulse signal Sj' output from the shift register 61 is calculated by the respective AND gates 631 (a j-th AND gate 631), and the result is output as the sampling signal Sj (S1, S2, . . . , Sn).

Here, as shown in FIG. 5, the enable signal ENB has a pulse at the timing corresponding to each of the pulse signals S1', S2', . . . , Sn', and each pulse of the enable signal ENB has a width narrower than that of each of the pulse signals S1', S2', . . . , Sn' such that a period (a pulse width) when each pulse becomes an active level is included in the period from the front edge to the rear edge of each of the pulse signals S1', S2', . . . , Sn'. More specifically, the enable signal ENB rises at the time when a predetermined time is delayed from the front edge of each of the pulse signals S1', S2', . . . , Sn', and falls at the time of a predetermined time ahead of the rear edge of each of the pulse signals S1', S2', . . . , Sn'. The sampling signal Sj is obtained by the logical product of the enable signal ENB and the pulse signal Sj' having such waveforms. Therefore, as shown in FIG. 5, the periods when the sampling signals S1, S2, . . . , Sn become the active levels are separated from each other in the axis of time (that is, the periods when the sampling signals become the active levels do not overlap each other).

Meanwhile, the sampling circuit 64 shown in FIG. 4 is a circuit to sequentially sample the image signals VID1 to VID6 supplied from the image signal processing circuit 2 through the six image signal lines 644 based on the sampling signals S1, S2, . . . , Sn and then to supply the sampled signals to the respective data lines 412. The sampling circuit 64 has sampling switches 641 provided for every data line 412. Each of the sampling switches 641 is a thin film transistor formed in the same manufacturing process as the process to form the TFTs 414. In addition, drains of the sampling switches 641 are connected to the data lines 412, and gates of six sampling switches 641 connected to the data lines 412 belonging to each block Bj are commonly connected to an output terminal of the corresponding AND gate 631. Further, sources of the six sampling switches 641 belonging to each block Bj are connected to the six image signal lines 644, respectively. More specifically, the source of a k-th sampling switch 641 (where k is a natural number in the range of 1 to 6) from the left of the six sampling switches 641 provided in each block Bj is commonly connected to the image signal line 644 supplied with an image signal VIDk.

Each of the image signal lines 644 extends to the element substrate 41 so as to reach the left end of the data line driving circuit 6 shown in FIG. 3 from the output terminal of the image signal processing circuit 2, and further extends at that point in the X direction, which is the direction in which the data lines 412 are arranged. In addition, the image signals VID1 to VID6 output from the image signal processing circuit 2 are transmitted from the point B located at the negative side of the image signal line 644 in the X direction toward the point A located at the positive side thereof (that is, in the right direction in FIGS. 3 and 4). In other words, the transmission direction of the enable signal ENB on the enable signal line 634 is reverse to the transmission direction of the image signals VID1 to VID6 on the image signal lines 644. As such, when the image signal lines 644 are provided to pass through one side of the data line driving circuit 6 and the enable signal line 634 is provided to pass through the other side of the data line driving circuit 6, a space on the element substrate 41 in which wiring lines are formed is divided into both sides of the data line driving circuit 6, which makes it possible to reduce a so-called dead space, compared to a structure in which both the image signal lines 644 and the enable signal line 634 pass through only one side of the data line driving circuit 6.

According to the above-mentioned structure, in the horizontal scanning period when the scanning signal Gi is turned to the active level to turn on six TFTs 414 belonging to an i-th row, the shift register 61 of the data line driving circuit 6 sequentially outputs the pulse signal Sj' corresponding to each block Bj. Here, it is assumed that the pulse signal Sj' corresponding to a j-th block Bj is input to a j-th AND gate 631 of the enable circuit 63. In this case, since the sampling signal Sj output from the AND gate 631 is turned to the active level in the period in which the enable signal ENB becomes the active level, the six sampling switches 641 belonging to the block Bj are simultaneously turned on. At this time, the image signals VID1 to VID6 supplied to the image signal lines 644 are sampled to the corresponding data lines 412 (six data lines 412 belonging to the block Bj), respectively, and are then supplied to the pixel electrodes 413 through the TFTs 414 that are maintained in an on state by the scanning line driving circuit 5. The sampling of the image signal VID is performed on all blocks B1, B2, . . . , Bn in each horizontal scanning period. As a result, a voltage corresponding to the image signal VID is applied to all pixel electrodes 413 arranged in a matrix of m rows by 6n columns, so that the arrangement direction of the liquid crystal 46 varies according to a difference in potential between the respective pixel electrodes 413 and the counter electrode 421.

As described above, in the present exemplary embodiment, the enable signal line 634 and the respective image signal lines 644 are used as all data lines 412. Here, parasitic capacitance is generated between the respective image signal lines 644 and the counter electrode 421 and between the enable signal line 634 and the counter electrode 421, respectively. Further, the respective signal lines 644 and the enable signal line 634 all are conductors having resistance. In the above-mentioned structure, signal distortion, such as waveform distortion or phase delay, can occur in the image signal VID or the enable signal ENB due to the parasitic capacitance or the resistance. The present inventors found out the fact that the signal distortion caused display irregularity, described in greater detail later.

Figure 6:
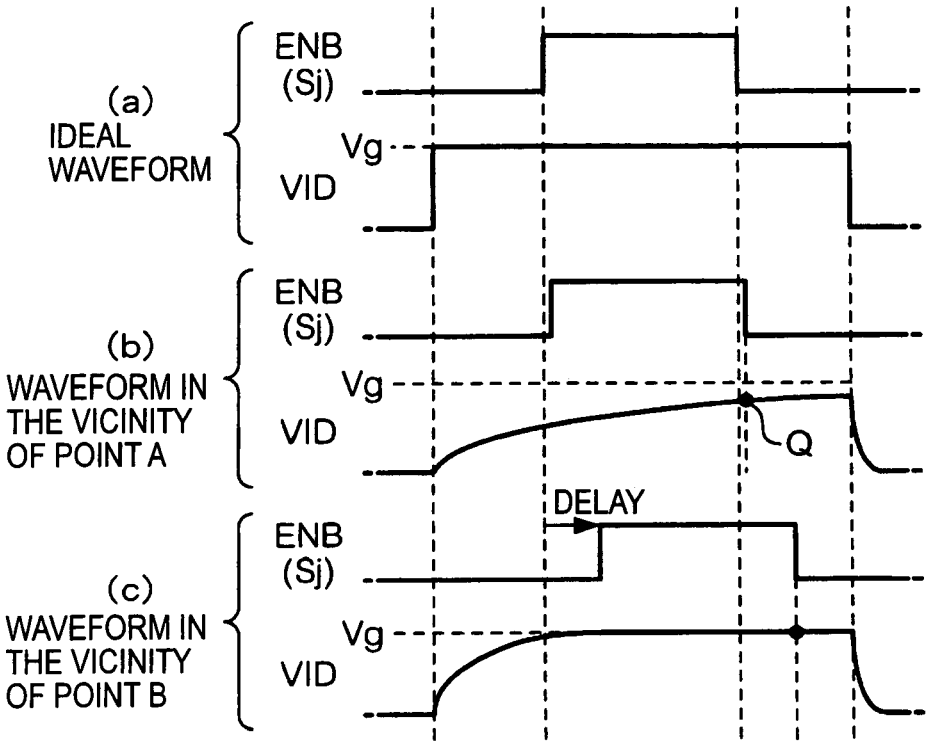
FIGS. 6*a* to 6*c* are views explaining signal distortion generated in an image signal and an enable signal.

FIG. 6 is a timing chart illustrating the relationship between the image signal VID transmitted through the respective image signal lines 644 and the enable signal ENB transmitted through the enable signal line 634. FIG. 6*a* is a view illustrating ideal waveforms (that is, theoretical waveforms) of the image signal VID and the enable signal ENB. As shown in FIG. 6*a*, the image signal VID ideally maintains a voltage level (hereinafter, referred to as 'a display level') Vg corresponding to the contents of an image during a period corresponding to six periods of the dot clock DCK, and the enable signal ENB becomes the active level within this period. However, since signal distortion occurs in the actual image signal VID and enable signal ENB, the actual waveforms of these signals are as shown in FIGS. 6*b* and 6*c*. FIG. 6*b* is a view illustrating the waveforms of the image signal VID and the enable signal ENB in the vicinity of the point A of FIG. 4, and FIG. 6*c* is a view illustrating the waveforms of the image signal VID and the enable signal ENB in the vicinity of the point B of FIG. 4.

The effects of the parasitic capacitance or the resistance on the enable signal ENB becomes larger as the enable signal ENB gets near to the downstream side in the transmission direction thereof. Therefore, as shown in FIGS. 6*b* and 6*c*, the enable signal ENB having reached the point B located at the downstream side of the point A in the transmission direction of the enable signal ENB is more delayed in phase than the enable signal ENB having reached the point A. Similarly, the effects of the parasitic capacitance or the resistance on the image signal VID becomes larger as the image signal VID gets near to the downstream side in the transmission direction. Therefore, as shown in FIGS. 6*b* and 6*c*, the image signal VID having reached the point A located at the downstream side of the point B in the transmission direction of the image signal VID is more largely distorted in phase than the image signal VID having reached the point B. As described above, the degrees of signal distortion in the X direction are different from each other. Therefore, the sampling circuit 64 completes sampling in the vicinity of the point B in a state in which the image signal VID has reached (or has approached) the display level Vg, and on the contrary, the sampling circuit 64 completes sampling in the vicinity of the point A before the image signal VID reaches the display level Vg (at a point represented by a letter 'Q' in FIG. 6*b*). Thus, even when the pixels belonging to one row are displayed at the same grayscale level, the closer the pixel electrodes 413 is connected to the data lines 412, the smaller a voltage to be applied thereto becomes. Therefore, an observer perceives a difference in grayscale level (display irregularity) caused by a difference in the applied voltage.

Figure 7:
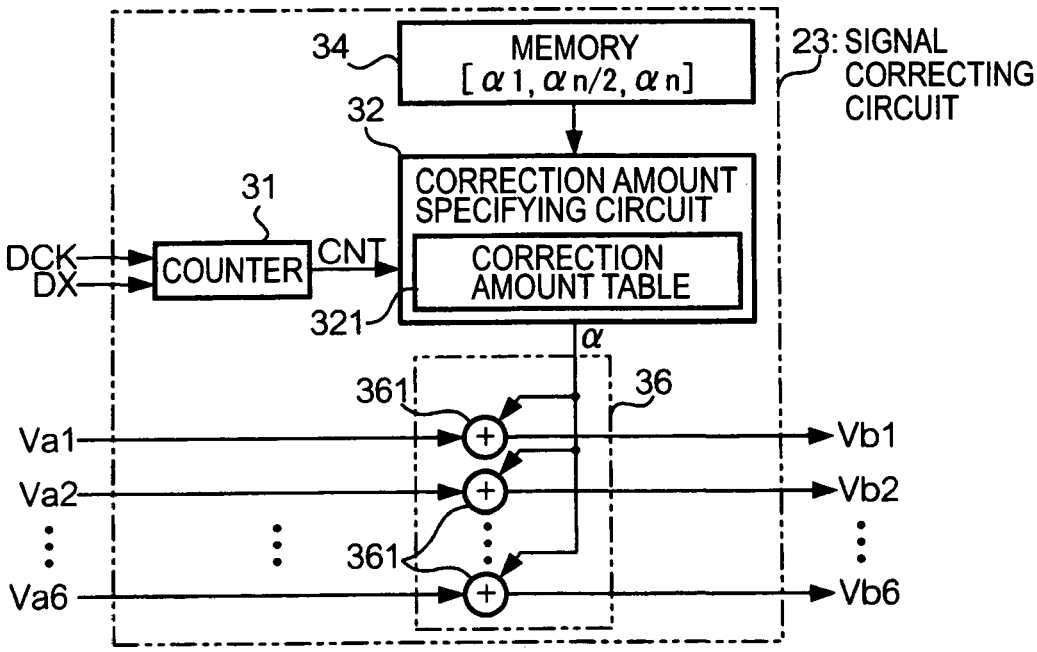
FIG. 7 is a schematic block diagram illustrating the structure of a signal correcting circuit of an image signal processing circuit in the liquid crystal device.

The signal correcting circuit 23 of the present exemplary embodiment is a circuit to correct the phase-developed image signals Va1 to Va6 such that the difference of the signal distortion is compensated. As shown in FIG. 7, the signal correcting circuit 23 has a counter 31, a correction amount specifying circuit 32, a memory 34, and a correcting circuit 36. The six phase-developed image signals Va1 to Va6 output from the S/P converting circuit 22 are supplied to the correcting circuit 36 to be corrected.

The counter 31 counts the dot clock DCK supplied from the control circuit 1 and outputs a count value CNT. In addition, the counter 31 resets the count value CNT whenever the transmission starting pulse DY is supplied from the control circuit 1. As such, the count value CNT is reset at the beginning of the horizontal scanning period such that the value is incremented by '1' every one period of the dot clock. Therefore, the count value CNT can be understood as a value for sequentially indicating six data lines 412 in the horizontal scanning period. It is possible to specify the block B corresponding to the phase-developed image signals Va1 to Va6 currently being input to the correcting circuit 36 (that is, the block B including six data lines 412 through which the image signals VID1 to VID6 obtained from the phase-developed image signals Va1 to Va6 are supplied), with reference to the count value CNT. For example, when the count value CNT is a value in the range of '0' to '5', it is possible to specify that the phase-developed image signals Va1 to Va6 currently being input to the correcting circuit 36, are signals corresponding to a first block B1. In addition, when the count value CNT is a value in the range of '6' to '11', it is possible to specify that the phase-developed image signals Va1 to Va6 currently being input to the correcting circuit 36 is signals corresponding to a second block B2.

Figure 8:
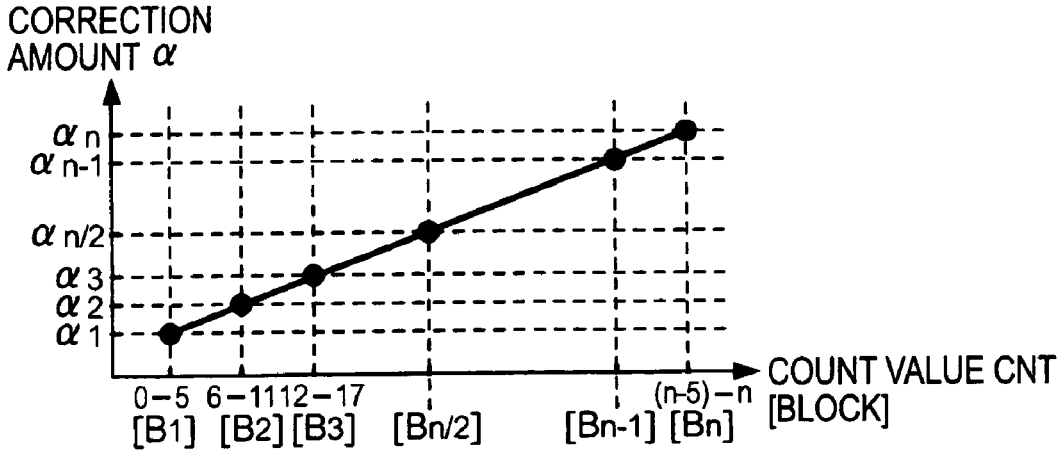
FIG. 8 is a view explaining the contents of a correction amount table of the signal correcting circuit.

In the meantime, the correction amount specifying circuit 32 is a circuit to specify a correction amount $\alpha$ based on the count value CNT from the counter 31. More specifically, the correction amount specifying circuit 32 specifies the correction amount $\alpha$ to correct the phase-developed image signals Va1 to Va6 corresponding to each block B indicated by the count value CNT. A correction amount table 321 is used to specify the correction amount $\alpha$. As shown in FIG. 8, the correction amount table 321 is a table in which the count value CNT by the counter 31 relates to the correction amount $\alpha$ ($\alpha 1, \alpha 2, \ldots, \alpha n$) used to correct the phase-developed image signals Va1 to Va2 corresponding to the block B indicated by the count value CNT. When the count value CNT is input from the counter 31, the correction amount specifying circuit 32 reads out the correction amount $\alpha$ corresponding to the count value CNT from the correction amount table 321 to output it to the correcting circuit 36.

Figure 9:
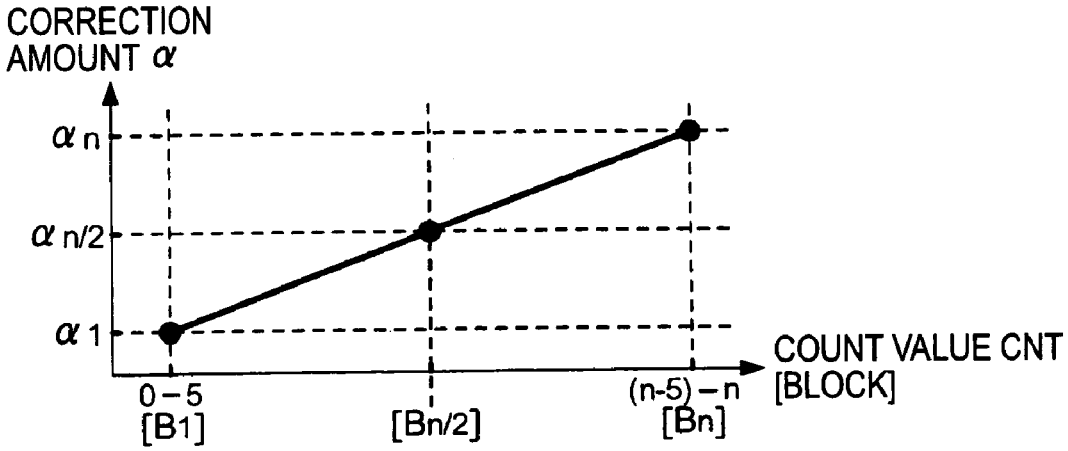
FIG. 9 is a view explaining the contents stored in a memory of the signal correcting circuit.

The correction amount table 321 of the present exemplary embodiment is previously created by interpolating some of the correction amounts $\alpha$ stored in the memory 34. That is, as shown in FIG. 9, only the correction amounts $\alpha$ with respect to some of n blocks B are stored in the memory 34, and the correction amounts $\alpha$ with respect to the other blocks B to be included in the correction amount table 321 are obtained by interpolating the correction amount $\alpha$ stored in the memory 34. FIG. 9 shows a case in which only the correction amounts $\alpha 1$, $\alpha n/2$, and $\alpha n$ of the first, n/2-th, and n-th blocks B (B1, Bn/2, and Bn) are stored in the memory 34. Therefore, at the timing immediately after the power of the liquid crystal device 100 is turned on (that is, at the timing before an image is displayed), or at the timing immediately after the operating mode is switched, the correction amounts $\alpha$ with respect to the other blocks B are calculated by linearly interpolating the three correction amounts $\alpha$, thereby creating the correction amount table 321 shown in FIG. 8. According to this structure, it is possible to reduce the amount of data related to the correction amounts $\alpha$ previously stored in the memory 34 and to arbitrarily change the contents (that is, the correction amount $\alpha$ for every block B) of the correction amount table 321 by appropriately selecting an interpolating method. Further, the contents of the correction amount table 321 set in the correction amount specifying circuit 32 are changed according to the operating mode, which will be described later.

Meanwhile, the correcting circuit 36 shown in FIG. 7 is a circuit to correct the phase-developed image signals Va1 to Va6 based on the correction amount α supplied from the correction amount specifying circuit 32, and has six adders 61 corresponding to the number of developed phases. As shown in FIG. 7, the phase-developed image signals Va1 to Va6 are supplied to these adders 61, respectively, and a common correction amount cc is supplied from the correction amount specifying circuit 32. Each of the adders 61 adds a phase-developed image signal Vak to the correction amount α and then outputs the added signal as a corrected image signal Vbk.

Next, the contents of the correction amount α used to correct the phase-developed image signals Va1 to Va6 will be described in detail.

Figure 10:
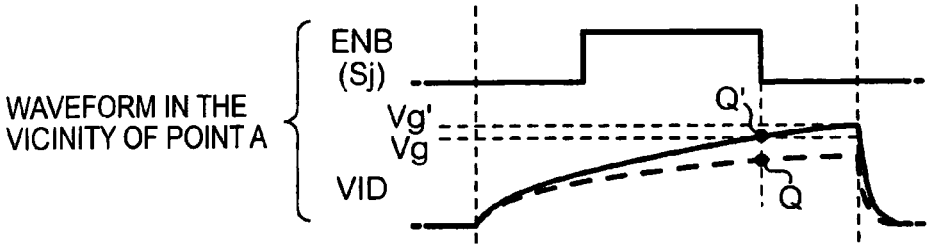
FIG. 10 is a view explaining the correction amount used in the signal correcting circuit.

The correction amount α is selected such that a difference in signal distortion according to the sampling position of the image signal VID on the image signal line 644 and a difference in signal distortion according to the extracting position of the enable signal ENB on the enable signal line 634 are removed. Here, the sampling switch 641 to control the connection/disconnection between the data line 412 and the image signal line 644 is turned on in response to the sampling signal Sj. Therefore, the voltage applied to the pixel electrodes 413 is determined at the timing when the sampling signal Sj is turned to an inactive level such that the sampling switch 641 is turned on, that is, at the timing when the level of the enable signal ENB falls. Therefore, in the present exemplary embodiment, as shown in FIG. 10, at the timing when the level of the enable signal ENB accompanying signal distortion falls, the correction amount α in the correction amount table 321 (or the correction amount α stored in the memory 34) is experimentally determined such that the voltage level of the image signal VID accompanying the signal distortion reaches the display level Vg (that is, the voltage level reaches a point Q' in FIG. 10). In other words, as shown in FIG. 10, by correcting the voltage level of the image signal VID to a display level Vg' higher than a predetermined display level Vg, the correction amount α is specified such that the voltage level when the image signal VID accompanying signal distortion is supplied to the pixel electrode 413 (that is, when the level of the enable signal ENB falls) becomes the display level Vg. In addition, in FIG. 10, a broken line indicates the image signal VID (the signal having the waveform shown in FIG. 6B) that is not subjected to correction. As described above, the voltage level of the image signal VID supplied to the pixel electrode 413 becomes lower more near to the downstream side of the image signal lines 644 in the transmission direction of the image signal VID. Therefore, the correction amount α in the correction amount table 321 (or the correction amount stored in the memory 34) becomes larger more near to the block B located at the downstream side in the transmission direction of the image signal VID).

Further, the values of the correction amount α set in the correction amount table 321 are different according to the operating mode. For example, in the first operating mode, sampling is performed along the direction D1 shown in FIG. 11. Therefore, as the count value CNT is larger, the data line 412 located at a more downstream side in the transmission direction of the image signal VID is indicated. Thus, as shown in FIG. 11A, in the correction amount table 321 set in the first operating mode, the larger the count value CNT is, the larger the correction amount α becomes.

Meanwhile, in the second operating mode in which the sampling direction of the image signal VID with respect to the data line 412 is inverted, the correction amount table 321 (or the correction amount α stored in the memory 34) is set such that the magnitude relationship between the count value CNT and the correction amount α is reverse to that of the first operating mode. That is, the correction amount α becomes larger more near to the block B located at the downstream side in the transmission direction of the image signal VID, which is similar to the first operating mode. However, as shown in FIG. 11, in the second operating mode, the correspondence between the count value CNT and the block B to be sampled is reverse to that of the first operating mode. For example, in the second operating mode, when the count value CNT is a value in the range of '0' to '5', the phase-developed image signals Va1 to Va6 currently being input to the correcting circuit 36 are specified so as to correspond to an n-th block Bn. When the count value CNT is a value in the range of '6' to '11', the phase-developed image signals Va1 to Va6 currently being input to the correcting circuit 36 are specified so as to correspond to an (n−1)-th block B(n−1). Therefore, as shown in FIG. 11B, in the correction amount table 321 corresponding to the second operating mode, a large correction amount α corresponds to a small count value CNT. Thus, the larger the count value CNT becomes, the smaller the correction amount α corresponding to the count value CNT becomes.

The correction amount α set as described above is added to the respective phase-developed image signals Va1, Va2, . . . , Va6 by the respective adders 61 of the correcting circuit 36. As a result, the voltage level of the image signal VID supplied to the pixel electrode 413 through the data line 412 in each block B substantially coincides with the display level Vg regardless of the position of the block B. Thus, according to the present exemplary embodiment, since the phase-developed image signals Va1 to Va6 are corrected by using the correction amount α according to the position of the data line 412 (more specifically, the sampling position of the image signal VID on the image signal line 644 and the extracting position of the enable signal ENB on the enable signal line 634), a difference in signal distortion according to the position of the data line 412 is corrected, thereby reducing or preventing display irregularity.

Exemplary Modifications

The above-mentioned exemplary embodiment is just an example for explaining the present invention. Therefore, various exemplary modifications and changes can be made without departing from the spirit or scope of the present invention. More specifically, the following exemplary modifications can be considered.

Figure 12:
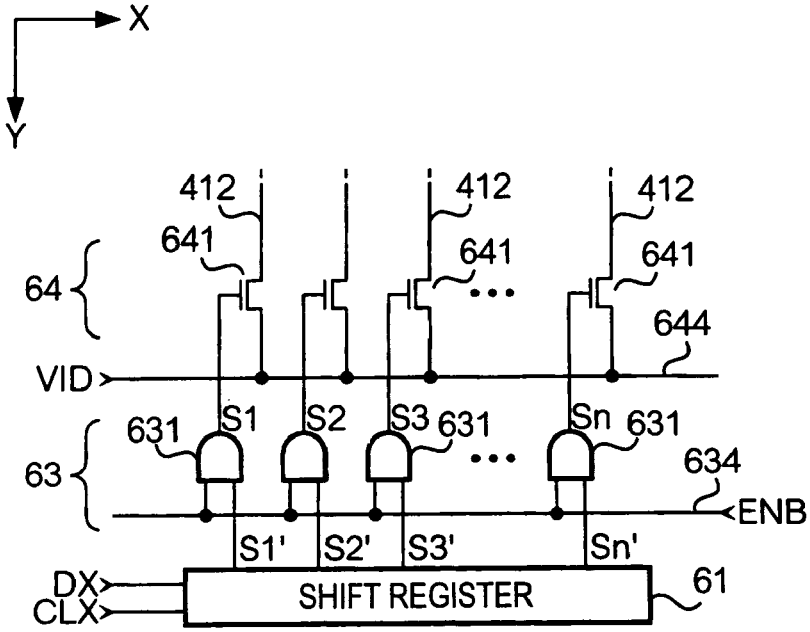
FIG. 12 is a schematic block diagram illustrating the structure of a data line driving circuit according to an exemplary modification.

(1) In the above-mentioned exemplary embodiment, the structure in which the image signal VID is sampled for every block B dividing the plurality of data lines 412 is exemplified. However, the image signal VID may be sampled with respect to each data line 412 (a dot-sequential manner). More specifically, as shown in FIG. 12, the AND gates 631 of the enable circuit 63 may be provided so as to respectively correspond to a total of n data lines 412, and the sources of n sampling switches 641 provided in the sampling circuit 64 may be commonly connected to one image signal line 644. In this structure, signal distortion may also occur in the image signal VID (here, one type) or the enable signal ENB. However, the use of the image signal processing device according to exemplary embodiments of the present invention (the image signal processing circuit 2 in the above-mentioned exemplary embodiment) makes it possible to correct a difference in signal distortion, thereby realizing high display quality. Further, in the above-mentioned exemplary embodiment having the structure in which the image signal VID is sampled for every block B, the degrees of signal distortion with respect to the image signal VID or the enable signal ENB are different from each other in the respective blocks B. Therefore, even when all pixels are displayed at the same grayscale level, stripe regions extending in the vertical direction to correspond to the plurality of data lines 412 belonging to one block B have different grayscale levels. Therefore, according to this structure, the observer can easily perceive a difference in grayscale level, compared to the case in which the sampling of the image signal VID is performed on every data line 412. In consideration of this matter, exemplary embodiments of the present invention can be preferably applied to the liquid crystal device 100 having the structure in which the sampling of the image signal VID is performed on every block B.

(2) In the above-mentioned exemplary embodiment, the transmission direction of the image signal VID is reverse to the transmission direction of the enable signal ENB. However, the transmission directions of these signals may be equal to each other. In the structure in which the image signal VID and the enable signal ENB have the same transmission direction, the waveform distortion of the image signal VID becomes larger and the phase delay of the enable signal ENB also becomes larger as these signals get near to the downstream side in the transmission direction thereof. Therefore, in this structure, even when the phase distortion of the image signal VID occurs, the time until the voltage level of the image signal VID approaches the display level Vg is secured by the amount corresponding to the phase delay of the enable signal ENB. Contrary to this structure, when the transmission direction of the image signal VID is reverse to the transmission direction of the enable signal ENB as in the above-mentioned exemplary embodiment, the waveform distortion of the image signal VID becomes larger, and the phase delay of the enable signal ENB becomes smaller as these signals get near to the downstream side in the transmission direction of the image signal VID (in other words, as the signals get near to the upstream side in the transmission direction of the enable signal ENB). That is, in the structure according to the above-mentioned exemplary embodiment, the time required for changing the image signal VID is shorter than that in the structure according to the present exemplary modification. Thus, exemplary embodiments of the present invention can be appropriately applied to the liquid crystal device 100 in which the transmission direction of the image signal VID is reverse to the transmission direction of the enable signal ENB.

(3) In the above-mentioned exemplary embodiment, the signal correcting circuit 23 is provided at the rear stage of the S/P converting circuit 22 to correct the phase-developed image signals Va1 to Va6. However, the position (that is, the timing of correction) of the signal correcting circuit 23 is not limited thereto. For example, the signal correcting circuit 23 may be provided at the front stage of the D/A converter 21 or the S/P converting circuit 22 to correct the image signal before phase development, or may be provided at the rear stage of the amplifying/inverting circuit 26 to correct the image signals VID1 to VID6.

(4) The structure shown in FIG. 7 is an example of the signal correcting circuit 23. That is, the signal correcting circuit 23 preferably has a function to correct the image signal VID with respect to the corresponding data line 412 based on the position of the data line 412 with respect to the direction in which the image signal line 644 extends or the position of the data line 412 with respect to the direction in which the enable signal line 634 extends. There is no restriction in its concrete structure if the circuit has the above-mentioned function. Further, in the above-mentioned structure, the correction amount table 321 is set by interpolating the correction amount α stored in the memory 34. However, the correction amount table 321 may be previously created. Furthermore, in the above-mentioned exemplary embodiment, the count value CNT by the counter 31 is used as a value indicating the position of the data line 412, but the structure to specify the position of the data line 412 is not limited thereto.

(5) In the above-mentioned exemplary embodiment, the correction amounts α related to all blocks B are calculated by linearly interpolating the correction amount α stored in the memory 34, but a method for interpolating the correction amount α is not limited thereto. For example, as shown in FIGS. 8 and 9, it is assumed that a predetermined curve passes coordinates corresponding to a combination of the count value CNT and the correction amount α stored in the memory 34 in a plane in which the count value CNT is the horizontal axis and the correction amount α is the vertical axis, and the correction amount α on the curve corresponding to each count value CNT may be calculated. In this case, the curve has any form. Further, the number of correction amounts α used for interpolation (three correction amounts α1, αn/2, and αn are used in the above-mentioned exemplary embodiment) may be arbitrarily set.

(6) In the above-mentioned exemplary embodiment, the control circuit 1, the image signal processing circuit 2, the scanning line driving circuit 5, and the data line driving circuit 6 are composed of separate integrated circuits. However, some or all of these circuits may be composed of a single integrated circuit. In addition, the function of the image signal processing circuit 2 may be realized by dedicated hardware (a circuit) or by allowing a calculation control device, such as a CPU, to execute a program.

(7) In the above-mentioned exemplary embodiment and the respective exemplary modifications, a liquid crystal device is used as an example, but exemplary embodiments of the present invention may be applied to electro-optical devices other than the liquid crystal device. That is, exemplary embodiments of the present invention may be applied any device to display an image using an electro-optical material that can convert an electrical action, such as the supply of an image signal, into an optical action, such as a variation in brightness or transmittance. For example, exemplary embodiments of the present invention can be applied to various electro-optical devices, such as a display device in which an OLED element, such as, an organic electroluminescent element or a light-emitting polymer, is used as an electro-optical material, a plasma display panel (PDP) in which high-pressure gas, such as beryllium or neon, is used as an electro-optical material, a field emission display (FED) in which a fluorescent substance is used as an electro-optical material, an electrophoresis display device in which a micro capsule containing colored liquid and white particles dispersed in the colored liquid is used as an electro-optical material, a twist ball display that uses twist balls in which different colored balls are coated to regions having different polarities as an electro-optical material, and a toner display in which a black toner is used as an electro-optical material.

Electronic Apparatuses

Next, electronic apparatuses equipped with the electro-optical device according to exemplary embodiments of the present invention will be described.

(1) Projector

Figure 13:
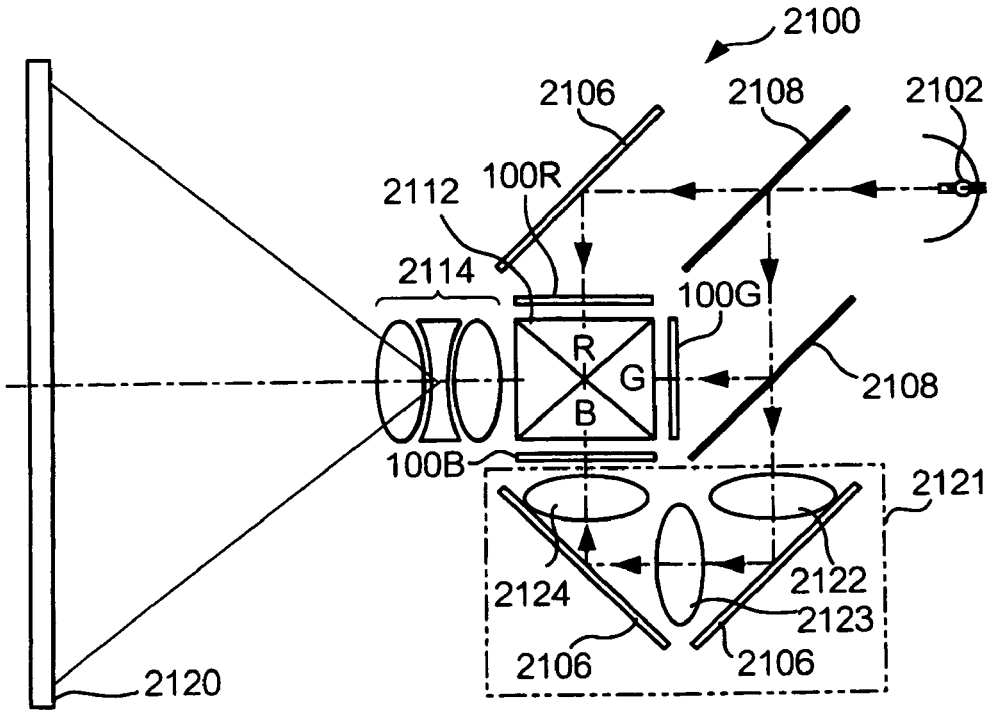
FIG. 13 is a schematic plan view illustrating the structure of a projector, which is an example of an electronic apparatus according to exemplary embodiments of the present invention.

FIG. 13 is a schematic plan view illustrating the structure of a projector in which the electro-optical device according to exemplary embodiments of the present invention (the electro-optical device 100 according to the above-mentioned exemplary embodiment) is used as a light valve. As shown in FIG. 13, a projector 2100 is provided with a lamp unit 2102 composed of a white light source, such as a halogen lamp. Projection light emitted from the lamp unit 2102 is divided into three light components having wavelengths corresponding to the three primary colors R, G, and B by three mirrors 2106 and two dichroic mirrors 2108, and the three light components are introduced to light valves 100R, 100G, and 100B, respectively. Since a light component corresponding to blue has an optical path longer than those of light components corresponding to the other colors, the blue light component is introduced to the light valve 100B via a relay lens system 2121 in order to reduce or prevent an optical loss. The relay lens system 2121 includes an incident lens 2122, a relay lens 2123, and an emission lens 2124.

Here, the light valves 100R, 100G, and 100B have the same structure as that of the liquid crystal device 100 in accordance with the above-mentioned exemplary embodiment and are driven by image signals corresponding to the respective colors R, G, and B, which are supplied from the image signal processing circuit 2. The light components modulated by these light valves 100R, 100G, and 100B are incident on a dichroic prism 2112 in different directions. In the dichroic prism 2112, the R light component and the B light component are refracted at an angle of 90°, while the G light component travels straight. In this structure, after a color image is synthesized from the respective colors, the color image is projected onto a screen 2120 through a projection lens 2114.

(2) Personal Computer

Figure 14:
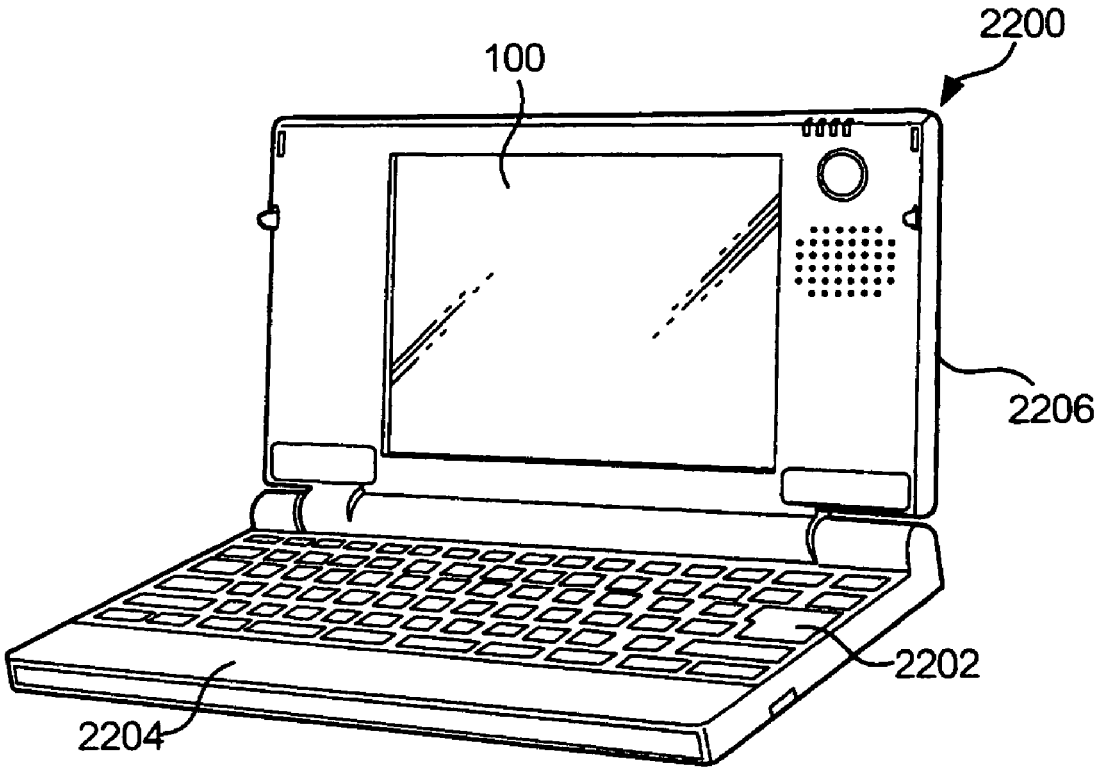
FIG. 14 is a schematic perspective view illustrating the structure of a personal computer, which is another example of the electronic apparatus according to exemplary embodiments of the present invention.

Further, an example in which the electro-optical device according to exemplary embodiments of the present invention is applied to a display unit of a portable personal computer (a so-called notebook computer) is described. FIG. 14 is a schematic perspective view illustrating the structure of the personal computer. As shown in FIG. 14, a personal computer 2200 is provided with a main body 2204 including a keyboard 2202 and a display unit 2206 including the liquid crystal device 100 according to the above-mentioned exemplary embodiment.

Further, the electro-optical device according to exemplary embodiments of the present invention can be applied to various electronic apparatuses, such as liquid crystal television sets, view finder type (or monitor-direct-view type) videotape recorders, car navigation apparatuses, pagers, electronic organizers, electronic calculators, word processors, workstations, television phones, POS terminals, and apparatuses provided with touch panels.

What is claimed is:

1. An image signal processing device used in an electro-optical device, comprising:

a plurality of pixel electrodes electrically connected to a plurality of scanning lines and a plurality of data lines through switching elements provided at intersections of the plurality of scanning lines and the plurality of data lines;

a counter electrode opposite to the plurality of pixel electrodes, with an electro-optical material interposed therebetween;

a scanning line driving circuit to sequentially select the plurality of scanning lines; and a data line driving circuit to sample an image signal supplied through an image signal line based on a sampling signal defined by an enable signal supplied from an enable signal line that is provided in common to the plurality of data lines and to supply the sampled signal to each data line, the image signal processing device including:

a specifying device to specify a correction amount of the image signal supplied to each data line based on a position of the data line with respect to an extending direction of the enable signal line; and a correcting device to correct the image signal based on the correction amount specified by the specifying device to supply the corrected image signal to the image signal line.

2. The image signal processing device according to claim 1, the correcting device changing a signal level of the image signal with respect to a voltage applied to the counter electrode by the correction amount, and the specifying device specifying the correction amount of each image signal such that the correction amount of the image signal supplied to the data line located at a downstream side of the image signal line in a transmission direction of the image signal is larger than the correction amount of the image signal supplied to the data line located at an upstream side of the image signal line in a transmission direction of the image signal.

3. The image signal processing device according to claim 1, the image signal being supplied to the image signal processing device as a serial signal synchronized with a clock signal having a predetermined period.

4. The image signal processing device according to claim 3, further comprising a counter to count the clock signal, the position of the data line in a second direction being determined by a result counted by the counter.

5. The image signal processing device according to claim 3, further comprising a phase developing circuit to convert the image signal, which is a serial signal, into a plurality of parallel signals.

6. The image signal processing device according to claim 1, the specifying device reading the correction amount corresponding to the data line to be supplied with the image signal from a storage unit in which the correction amounts respectively corresponding to two or more data lines are stored and using the read correction amount as the correction amount of the image signal.

7. The image signal processing device according to claim 1, further comprising:

a phase developing device to phase-develop the image signal into plural types of image signals and to output the phase-developed signals, the data line driving circuit simultaneously supplying the image signals phase-developed by the phase developing device to respective data lines corresponding to a number of phases developed by the phase developing device.

8. An image signal processing device used in an electro-optical device, comprising:

an image signal line extending in an extending direction;

a plurality of scanning lines;

a plurality of data lines being aligned in the extending direction of image signal line;

a plurality of pixel electrodes electrically connected to the plurality of scanning lines and the plurality of data lines through switching elements provided at intersections of the plurality of scanning lines and the plurality of data lines;

a counter electrode opposite to the plurality of pixel electrodes, with an electro-optical material interposed therebetween;

a scanning line driving circuit to sequentially select the plurality of scanning lines;

a data line driving circuit to sample the image signal supplied from an image signal line that is provided in common to the plurality of data lines and to supply the sampled signal to each data line;

a specifying device to specify a correction amount of the image signal supplied to each data line based on a position of the data line with respect to the extending direction of the image signal line; and a correcting device to correct the image signal based on the correction amount specified by the specifying device to supply the corrected image signal to the image signal line, the specifying device reading the correction amount corresponding to the data line to be supplied with the image signal from a storage unit in which the correction amounts respectively corresponding to two or more data lines are stored and using the read correction amount as the correction amount of the image signal, the storage unit storing the correction amounts corresponding to some of the plurality of data lines, and the specifying device specifying the correction amounts corresponding to the other data lines of the plurality of data lines by interpolating the correction amount read from the storage unit.

9. An image signal processing device used in an electro-optical device, comprising:

an image signal line extending in an extending direction;

a plurality of scanning lines;

a plurality of data lines being aligned in the extending direction of image signal line;

a plurality of pixel electrodes electrically connected to the plurality of scanning lines and the plurality of data lines through switching elements provided at intersections of the plurality of scanning lines and the plurality of data lines;

a counter electrode opposite to the plurality of pixel electrodes, with an electro-optical material interposed therebetween;

a scanning line driving circuit to sequentially select the plurality of scanning lines;

a data line driving circuit to sample the image signal supplied from an image signal line that is provided in common to the plurality of data lines and to supply the sampled signal to each data line;

a specifying device to specify a correction amount of the image signal supplied to each data line based on a position of the data line with respect to the extending direction of the image signal line; and a correcting device to correct the image signal based on the correction amount specified by the specifying device to supply the corrected image signal to the image signal line, the data line driving circuit sampling the image signal according to a first operating mode in which the sampling of the image signal is sequentially performed from the data line located at one side of an arrangement direction of the plurality of data lines toward the data line located at an other side thereof or a second operating mode in which the sampling of the image signal is sequentially performed from the data line located at an other side of an arrangement direction of the plurality of data lines towards the data line located at a one side thereof, and the specifying device specifying the correction amount of the image signal based on a position of the data line and an operating mode of the data line driving circuit.

10. An image signal processing device used in an electro-optical device, comprising:

a plurality of pixel electrodes electrically connected to a plurality of scanning lines and a plurality of data lines through switching elements provided at intersections of the plurality of scanning lines and the plurality of data lines;

a counter electrode opposite to the plurality of pixel electrodes, with an electro-optical material interposed therebetween;

a scanning line driving circuit to sequentially select the plurality of scanning lines;

an output circuit to output a pulse signal in a predetermined period; and a data line driving circuit including a sampling circuit to sample an image signal supplied through an image signal line based on a sampling signal obtained by a logical product of an enable signal supplied from an enable signal line and the pulse signal output from the output circuit and to supply the sampled signal to each data line, the image signal processing device including:

a specifying device to specify a correction amount of the image signal supplied to each data line based on a distance from a terminal to which the enable signal is input to a point where the enable signal is output to the sampling circuit on the enable signal line; and a correcting device to correct the image signal based on the correction amount specified by the specifying device to supply the corrected image signal to the image signal line.

11. An electro-optical device including an image signal processing device, the image signal processing device comprising:

an image signal line extending in an extending direction;

a plurality of scanning lines;

a plurality of data lines being aligned in the extending direction of image signal line;

a plurality of pixel electrodes electrically connected to the plurality of scanning lines and the plurality of data lines through switching elements provided at intersections of the plurality of scanning lines and the plurality of data lines;

a counter electrode opposite to the plurality of pixel electrodes, with an electro-optical material interposed therebetween;

a scanning line driving circuit to sequentially select the plurality of scanning lines;

a data line driving circuit to sample the image signal supplied from an image signal line that is provided in common to the plurality of data lines and to supply the sampled signal to each data line, the data line driving circuit including:

an output circuit to sequentially output a pulse signal within a period in which one of the scanning lines is selected by the scanning line driving circuit, an enable circuit to calculate the logical product of an enable signal supplied to an enable signal line and a pulse signal output from the output circuit and to output a calculated result as the sampling signal, and a sampling circuit to sample the image signal supplied to the image signal line based on the sampling signal output from the enable circuit and to supply the sampled signal to each data line, the enable signal line and the image signal line being wiring lines each having a portion extending in an arrangement direction of the data line, and a transmission direction of the enable signal on the enable signal line is reverse to a transmission direction of the image signal on the image signal line;

a specifying device to specify a correction amount of the image signal supplied to each data line based on a position of the data line with respect to the extending direction of the image signal line; and a correcting device to correct the image signal based on the correction amount specified by the specifying device to supply the corrected image signal to the image signal line.

12. An electronic apparatus, comprising:

the electro-optical device according to claim 11.

13. An image signal processing method used in an electro-optical device comprising a plurality of pixel electrodes electrically connected to a plurality of scanning lines and a plurality of data lines through switching elements provided at intersections of the plurality of scanning lines and the plurality of data lines; a counter electrode opposite to the plurality of pixel electrodes, with an electro-optical material interposed therebetween; a scanning line driving circuit for sequentially selecting the plurality of scanning lines to turn on the switching element corresponding to the selected scanning line; and a data line driving circuit for sampling an image signal of an image signal line based on a sampling signal corresponding to the logical product of a pulse signal sequentially generated in a period in which the scanning line is selected and an enable signal supplied to an enable signal line common to the plurality of data lines and for supplying the sampled signal to each data line, the method, comprising:

specifying a correction amount of the image signal to be supplied to each data line based on a position of the data line with respect to an extending direction of the enable signal line; and correcting the image signal based on the specified correction amount to supply the corrected image signal to the image signal line.

* * * * *